United States Patent [19]

Ruane

[11] 4,149,474

[45] Apr. 17, 1979

[54] PASS-BOX SYSTEM FOR TRANSFERRING ITEMS

[76] Inventor: Richard M. Ruane, 401 Summit Ave., Fallston, Md. 21047

[21] Appl. No.: 839,668

[22] Filed: Oct. 5, 1977

[51] Int. Cl.[2] ..... E05G 7/00

[52] U.S. Cl. ..... 109/19; 186/1 C; 232/43.3; 312/212

[58] Field of Search ..... 109/10, 17, 19, 66; 232/43.2, 43.3, 43.4, 44; 312/212; 186/1 C

[56] References Cited

U.S. PATENT DOCUMENTS

| | | | |
|---|---|---|---|
| 1,256,360 | 2/1918 | Ohlson et al. | 109/19 |
| 1,302,052 | 4/1919 | Jaeger | 232/43.3 |
| 1,885,165 | 11/1932 | Willems | 109/19 |
| 2,183,819 | 12/1939 | Mullen | 109/19 |
| 2,980,040 | 4/1961 | Breuning | 109/19 |

*Primary Examiner*—Mervin Stein
*Assistant Examiner*—David H. Corbin
*Attorney, Agent, or Firm*—John F. McClellan, Sr.

[57] ABSTRACT

A passbox type dispensing system designed for food dispensing to motorists at drive-in type restaurants but usable in banks, liquor stores and similar applications, includes a fixed longitudinal way with a rectangular-shape tubular longitudinal housing on the dispensing end, a movable way adapted for passage along the fixed way and carrying with it on a transverse pivotal-axis a handle-equipped quarter-cylinder proportioned for near sliding fit within the tubular housing; a money clip, a change recess, a pin lock, weather seals and an end buffer are supplied; the housing and quarter cylinder are preferably transparent, and an exterior door may be provided.

7 Claims, 8 Drawing Figures

PASS-BOX SYSTEM FOR TRANSFERRING ITEMS

This invention relates generally to dispensing systems and particularly to passbox-type systems.

In the prior art passboxes have been known but it is believed that the present invention advances the art in accordance with the following objects:

A principal object is to provide an alternating closure passbox which after loading can be extended toward the dispensing location, greatly aiding the delivery of food as through an exterior wall or window of a drive-in restaurant to the occupants of a motor vehicle;

Further objects are to provide a passbox of the type described which affords high visibility at all times from both ends, but which interlocks to prevent extension without uncovering the load, and which can shut out weather, open or closed.

Still further objects are to provide a passbox as described, which uses the space available to the maximum; which is self-protective, which provides good loading and visual and verbal access, which is easily installed and tamper resistant, which can employ only two moving parts for operation and one for locking, which is safe, sanitary, reliable, economical, durable and attractive in appearance.

In brief summary given for cursive description and not as limitation the invention includes a moving way carrying a movable closure through a tunnel-like tubular housing.

The above and other objects and advantages of the invention will become more readily understood on examination of the following description and the Figures in which like reference numerals designate like parts:

Figure 4A:
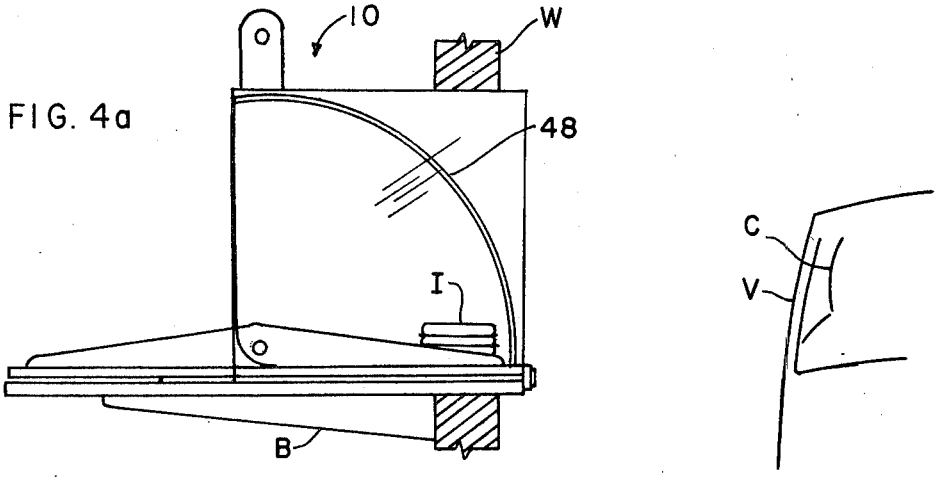
Figure 4B:
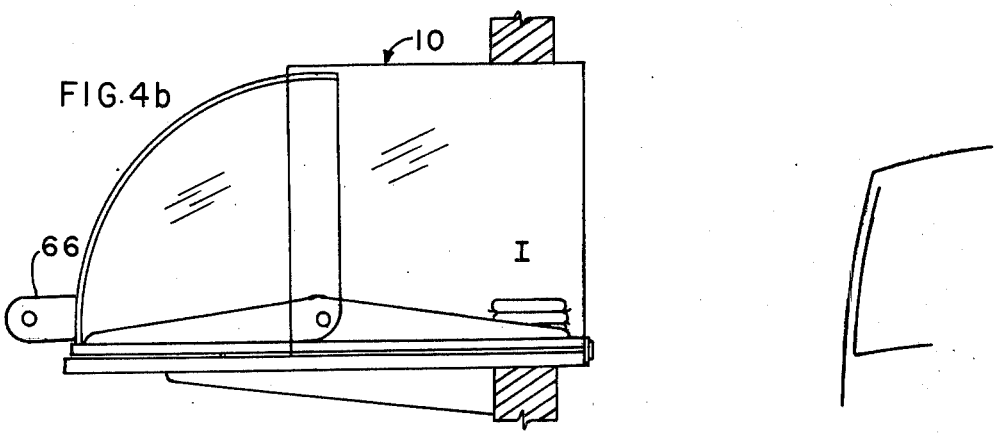
Figure 4C:
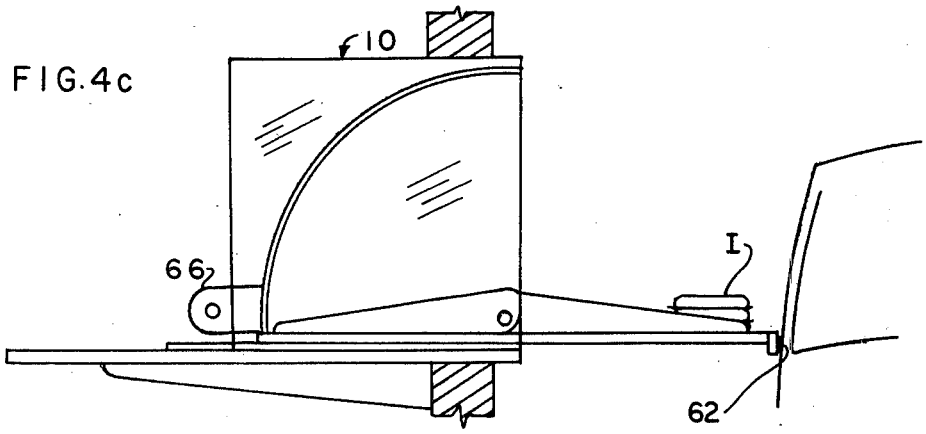
Figure 5:
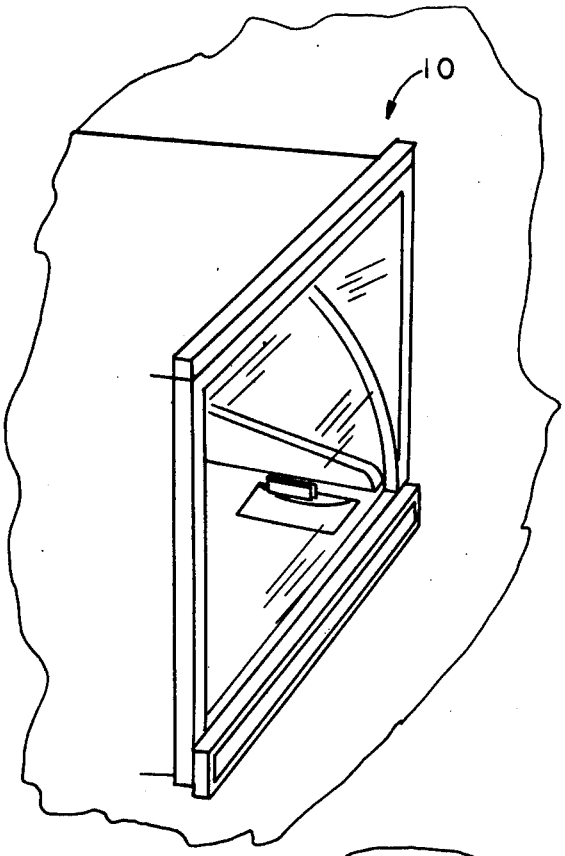
Figure 6:
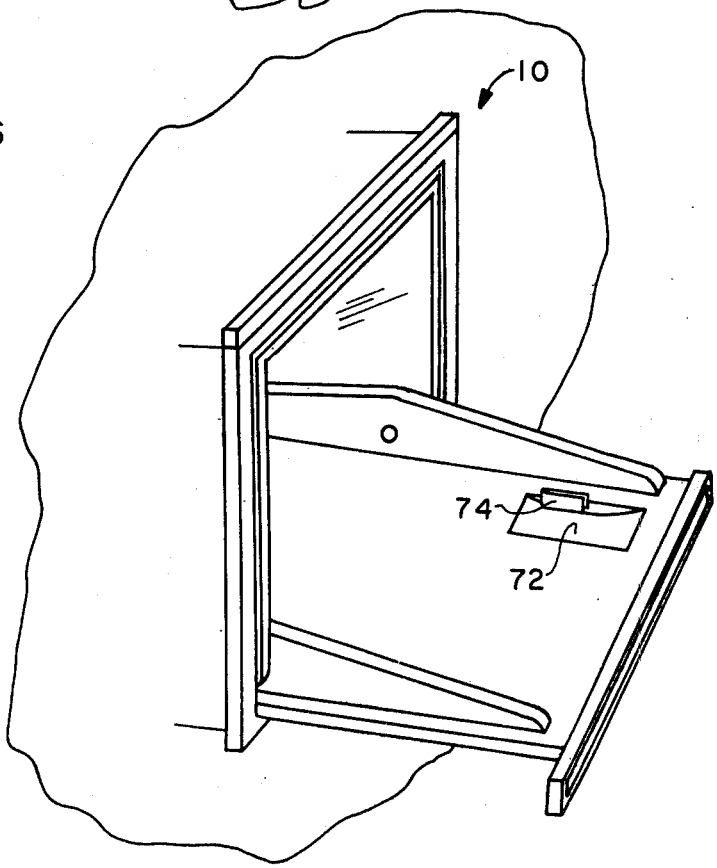

FIGS. 4*a*, 4*b* and 4*c* are side elevational diagrams of three successive positions of operation of the invention;

FIG. 5 is a perspective view of the delivery end of the invention retracted in loading position; and FIG. 6 is a perspective view of the delivery end of the invention extended in dispensing position.

STRUCTURE

Figure 1:
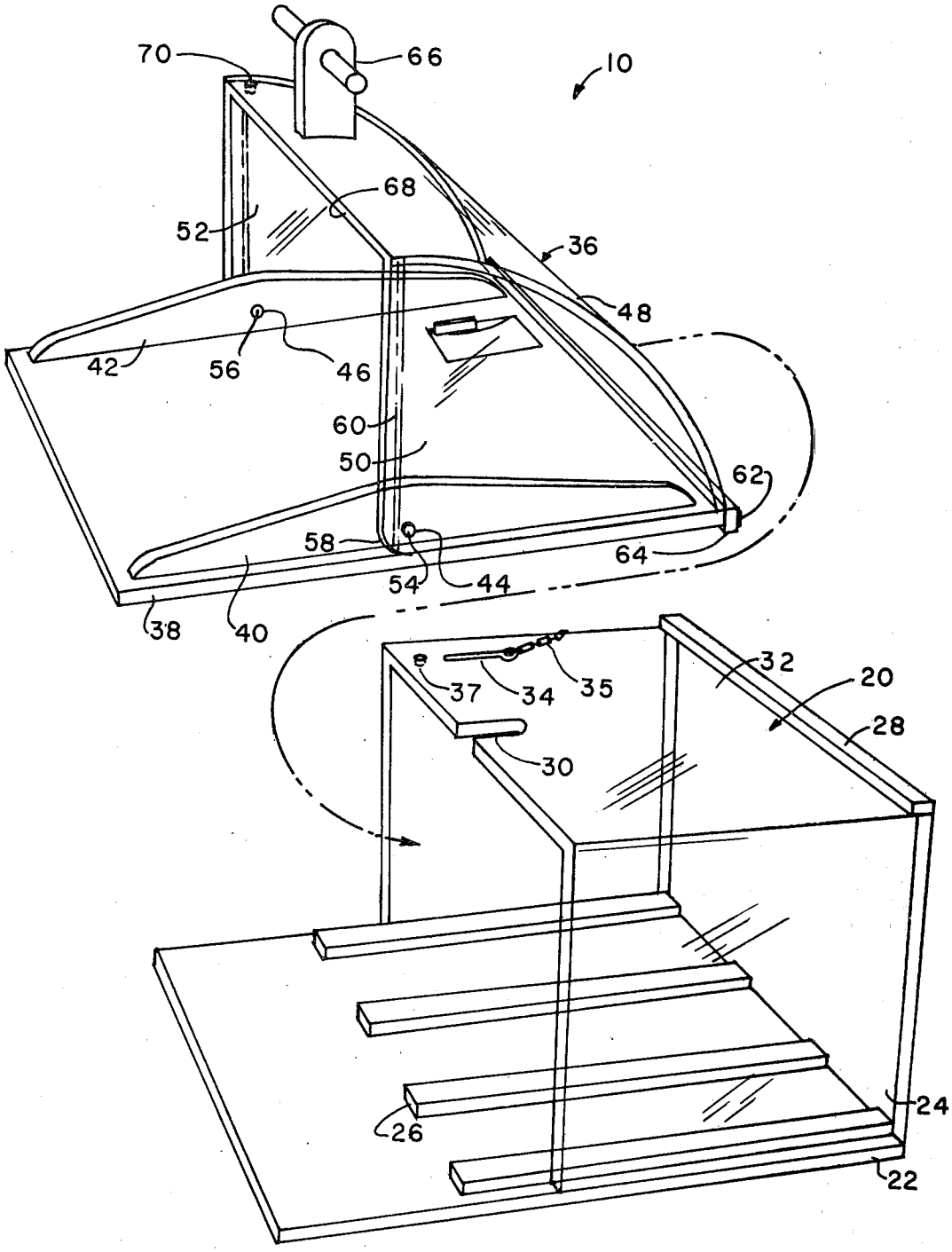
FIG. 1 is an exploded perspective view.

FIG. 1 shows the invention 10 in exploded view as consisting of two major subassembles.

The first subassembly 20 is fixed in place through a wall on installation and consists of a longitudinal rectangular base 22 having as an integral part a preferably transparent rectangular tubular housing 24 at one end, the output end, and has fixed way structure 26, preferably anti-friction, for mounting the second subassembly for movement along the base, back and forth in the housing. The housing preferably has also a mounting strip 28 across the top of the output end to act as a weather seal and facilitate mounting horizontally in a wall through which the fixed unit is installed at that end.

Also visible are a slot 30 longitudinally through the middle of the input end of the top 32 of the housing and on the side a locking pin 34 preferably having chain connection 35 to the top of the housing and a matching locking hole 37 in the top of the housing for coacting in locking as described below; a locking arrangement may be provided in spaced relation on the respective sides for greater strength and security.

The second or moving subassembly 36 comprises a moving way 38 of rectangular shape proportioned for moving back and forth on the base and having along each side in spaced relation with the side an upstanding rib 40, 42. Coaligned pivot apertures 44, 46 centrally in the ribs pivotally carry a quarter-cylinder-shaped hood 48 transversely of the moving way by means of respective segments 50, 52 integral with the ends of the hood and having pivots 54, 56 on the cylinder axis engaging the outboard sides of the ribs. The apex 58 of each segment has a radius forming a running fit with the moving way when the hood is pivoted; the segments can similarly form a running fit with the space between the ribs and the housing sidewalls and the quarter cylindrical portion can form a running fit with the housing top, but preferably space is provided and gaskets 60 seal between these elements. The pivotal arc of the hood is proportioned substantially to enclose both ends of the movable way.

A resilient bumper 62 is supplied on a flange 64 across and extending below the output end of the moving way for purposes to be described. A "T" handle 66 upstands from the central portion of the inner edge 68 of the hood at a location to pass into slot 30 at one position of operating after assembly; at that same position of operation locking holes 70 in the quarter-cylindrical housing align with the locking holes in the housing for receiving the locking pin and simultaneously locking hood and movable way.

Figure 2:
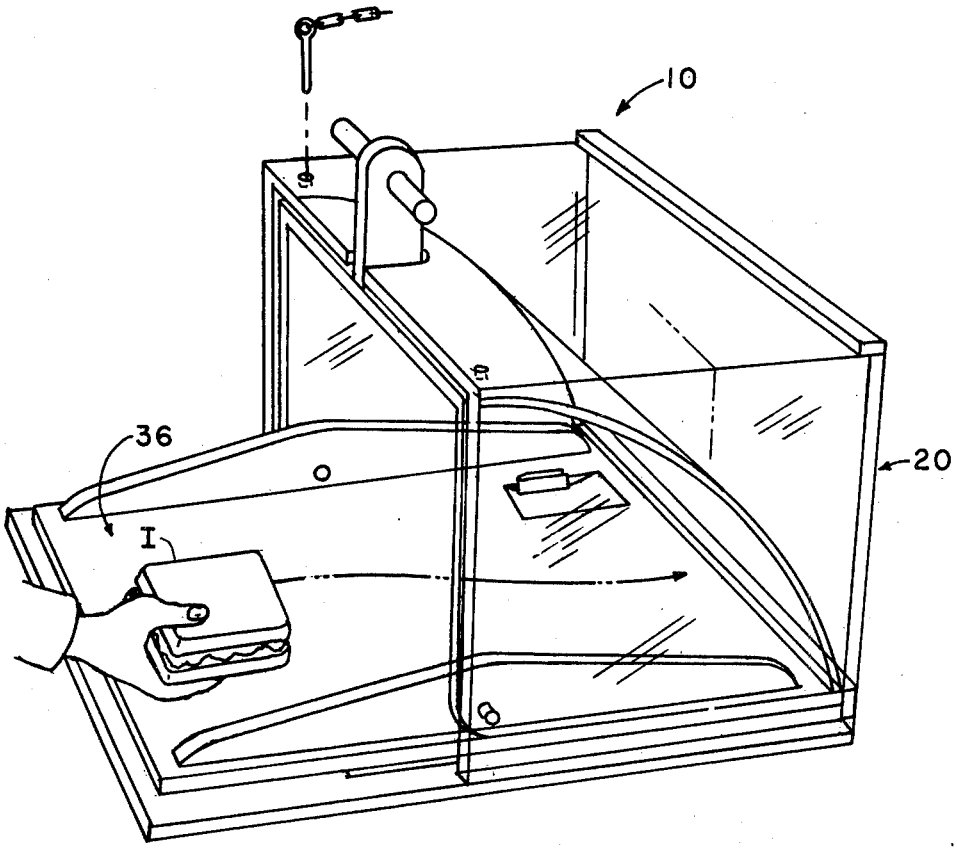
FIG. 2 is an assembled perspective view.

FIG. 2 shows the general aspect of the input end with the two subassemblies 20, 36 together and ready for passing an item I to the exterior through an aperture in a wall, represented by the phantom lines.

Figure 3:
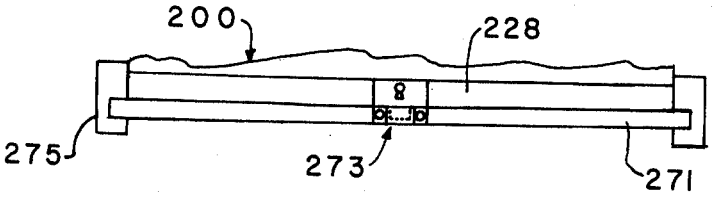
FIG. 3 is a plan view detail of an alternative embodiment.

FIG. 3 shows in alternate embodiment 200 that an independent vertically-sliding door 271 with lock 273 to the frame may be provided at the output end in guides 275, the structure otherwise being similar to that of the second Figure. If desired the same arrangement can be employed for a laterally sliding lockable closure; in either case the sliding door may be transparent. Mounting strip 228 corresponds to 28.

FIG. 4*a* shows the first position of delivery in which an item I is loaded adjacent the output end. W, the building wall is adjacent the drive along which customers drive vehicles V to pick up food, for example. A brace B may be used for additional support.

For this operation the hood 48, the open end of which is flush with the housing, isolates the input end from the output end by being in the position rotated toward the front or output end, presenting the convex portion to the exterior. The adjacent edge of the convex portion is substantially in the plane of the output end of the housing for compactness, efficient space use, and protection from damage, and the hood spaciously encloses almost all of the moving way, so that the item to be delivered can be placed at the farthest position practicable toward the output end and yet be protected; pin (34) may be used to lock the hood here until ready for the next step. The customer C can see the progress made but will not yet take the item for two reasons; the hood and the distance from the vehicle to the item. The input end of the moving way helpfully extends a substantially portion (almost half) of the length to the interior beyond the housing and the fixed way interior extension is slightly greater, preventing bumping the unit outwardly by accident.

FIG. 4*b* shows the invention in the first-transfer position, unlocked, with the handle 66 pulled all the way toward the input end, rotating the hood to closed position at that end of the moving slide. As before, the open end edges of the hood are sealingly within the housing.

Only after the hood is placed in this position can the moving way be advanced for delivery, as in the next Figure because the handle grip crosspiece catches above the slot (30) if this is attempted even though the pin is removed.

FIG. 4c shows the final position, the handle 66 which is conveniently toward the operator is pushed, advancing the moving way and item conveniently to the very window of the customer's vehicle; resilient bumper 62 prevents any damage. A substantial portion, nearly half, of the length of the moving way extends beyond the housing.

Money may be transferred using this sequence of operation at any time, before, doing, or after delivery of the item.

The item is exposed to the exterior (dust, flies, hot or cold weather) for only a few seconds. In rain, sleet or snow the hood may be partially rotated toward the output and to provide protective overhang as indicated by the dotted-lines.

FIG. 5 shows the output end prior to delivery, the sanitary, self-protective features which still provide good visibility, and the all-weather protection.

FIG. 6 shows the output end in the extended position. Further features notable here are a change recess 72 in the moving way at one side on the end and along that a resilient "U" clip 74 for paper money.

Ease of installation is apparent in the regular rectangular section with no awkward protrusions if desired, the unit can as easily be installed behind an openable window of a building, which can be raised or swung away during business hours.

It will be appreciated that when the hood is partially open, verbal communication can be carried on conveniently between interior and exterior.

Material for the invention is preferably "Lucite", "Plexiglass" or other transparent plastic for the housing and hood, and similar plastic, transparent or not, may be employed for the entire unit; hood and housing may be from one-fourth inch to one-half inch (6.3 to 12.6 mm) thick although other thicknesses may be employed, the base and way being of similar material although not necessarily transparent, and rigid. Size is not critical, the preferred embodiment for fast food being large enough to pass out several orders of average bulk food and drink, packaged compactly. Extension/retraction distance for this size may easily be in the one and one-half to two foot range or more, depending on proportion desired.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. A passbox system for transferring items such as food from a first area to a second area, as from the interior of a restaurant to a motorist in a vehicle a distance beyond an exterior wall of the restaurant, comprising: a first sub-assembly including a rectangular housing with tubular shape for fixing as a passage through a said wall; a second subassembly including: a movable way having elongate proportion for passing back and forth toward said interior and exterior respectively in said passage, a unitary quarter-cylindrical hood, means for pivoting the hood about a transverse axis intermediate the length of the movable way and alternately exposing a portion of the movable way to the first area and to the second area for thereby transferring said items, the hood having at each end thereof a segment-shaped member extending radially inward to said pivoting means, gasket sealing means between the segment shaped member and housing, the movable way proportioned for extending, when toward said exterior, a substantial portion of the length thereof beyond the first subassembly for facilitating item-transfer to a said motorist in a vehicle or the like; the movable way proportioned when moved towards said interior for extending a substantial portion thereof past the housing for facilitating loading items on the movable way, and the hood proportioned for remaining generally flush with the housing when exposing said portion of the movable way to the second area with the movable way moved fully toward said exterior.

2. A passbox system as recited in claim 1, the housing having a slot on the end thereof toward said interior; the hood having a handle extending upwardly through the slot in position requiring pivoting of the hood upon moving the movable way toward said exterior.

3. A passbox system as recited in claim 2, the handle having a grip above and transversely across the slot in position for substantially preventing movement of the movable way without pivoting the hood.

4. A passbox system as recited in claim 3, a fixed way beneath the movable way and integral with and coextensive with the housing towards said exterior, and the hood proportioned for covering and shutting against a first end of the movable way in a first pivotal position and for covering and shutting against a second end of the movable way in a second pivotal position.

5. A passbox system as recited in claim 4, means for simultaneously locking the pivotal motion of the hood and the movement of the movable way, said locking being with the movable way in position toward, and providing access from, said interior or first area, but preventing access from said exterior or second area, said means for simultaneously locking including a pin, and the housing and hood having coalignable holes for receiving the pin.

6. A passbox system as recited in claim 5, and a second said means for simultaneously locking in spaced relation with the first said means for simultaneously locking.

7. A passbox system as recited in claim 5, at least the hood being of transparent material for facilitating visual communication aiding said transfer of items, and the movable way having means for holding money thereon in position for coverage by the hood to prevent access thereto from said exterior.

* * * * *